US012180698B2

(12) United States Patent
Bonamour du Tartre

(10) Patent No.: US 12,180,698 B2
(45) Date of Patent: Dec. 31, 2024

(54) HALF-TIMBERED HOUSE IN TIMBER-FRAME CONSTRUCTION

(71) Applicant: Andre Bonamour du Tartre, Puylaroque (FR)

(72) Inventor: Andre Bonamour du Tartre, Puylaroque (FR)

( * ) Notice: Subject to any disclaimer, the term of this patent is extended or adjusted under 35 U.S.C. 154(b) by 70 days.

(21) Appl. No.: 18/155,402

(22) Filed: Jan. 17, 2023

(65) Prior Publication Data

US 2024/0117624 A1 Apr. 11, 2024

(30) Foreign Application Priority Data

Jan. 18, 2022 (DE) ..... 102022200474.4

(51) Int. Cl.
*E04B 1/26* (2006.01)
*E04B 1/19* (2006.01)
*E04B 1/76* (2006.01)

(52) U.S. Cl.
CPC ..... *E04B 1/26* (2013.01); *E04B 1/19* (2013.01); *E04B 1/7654* (2013.01); *E04B 2001/1945* (2013.01); *E04B 2001/199* (2013.01)

(58) Field of Classification Search
CPC . E04B 1/19; E04B 1/26; E04B 1/7654; E04B 2001/1945; E04B 2001/199
USPC ..... 52/90.1
See application file for complete search history.

(56) References Cited

U.S. PATENT DOCUMENTS 1,475,387 A * 11/1923 Holmes ..... E04G 9/06 52/630
2,542,151 A * 2/1951 McAuliffe, Jr. ..... E04B 1/26 52/262
2,601,819 A * 7/1952 Redford ..... E04B 1/26 454/339
4,187,652 A * 2/1980 Bobrovnikov ..... E04B 1/24 52/643
4,194,327 A * 3/1980 Simone ..... E04B 1/19 52/86
5,031,371 A * 7/1991 Davister ..... E04B 1/1909 52/236.1
6,088,989 A * 7/2000 Matsu ..... A47B 47/04 52/36.5
6,240,694 B1 * 6/2001 Castano ..... E04B 1/3211 52/654.1
7,634,888 B2 * 12/2009 Cloyd ..... E04C 3/42 52/693
8,438,792 B2 * 5/2013 Schwartz ..... E04B 1/7654 52/404.1

(Continued)

FOREIGN PATENT DOCUMENTS

AT 398446 B * 12/1994 ..... E04B 1/3205
BE 1018991 A3 * 12/2011 ..... E04D 13/1625

(Continued)

*Primary Examiner* — Brian D Mattei
*Assistant Examiner* — Joseph J. Sadlon
(74) *Attorney, Agent, or Firm* — Faegre Drinker Biddle & Reath LLP

(57) ABSTRACT

A half-timbered house having a multi-shell wall structure including a rafter roof having a plurality of rafters and side walls, which in turn each comprise at least one sill resting on a substrate and a plurality of posts. The multi-shell wall structure has two structural frameworks, wherein the first structural framework faces the interior and the second structural framework faces the surroundings.

18 Claims, 3 Drawing Sheets

(56) References Cited

U.S. PATENT DOCUMENTS 8,590,262 B1 * 11/2013 Fluga ..... E04B 1/26 52/741.1
8,763,345 B2 * 7/2014 Cloyd ..... E04B 1/10 52/693
8,844,226 B2 * 9/2014 Harkins ..... E04D 3/3602 126/621
9,422,713 B2 * 8/2016 Trebil ..... E04B 1/0007
10,156,067 B2 * 12/2018 Albright ..... F16B 5/07
10,526,780 B2 * 1/2020 Espinosa ..... E04C 3/292
10,575,473 B2 * 3/2020 Kawabata ..... D06M 11/83
10,858,822 B2 * 12/2020 Mori ..... E04B 1/5831
2003/0167713 A1 * 9/2003 Yost ..... E04B 2/8635 52/259
2009/0107064 A1 * 4/2009 Bowman ..... E04B 1/26 52/404.1
2009/0145075 A1 * 6/2009 Oakley ..... E04C 3/12 52/690
2011/0130062 A1 * 6/2011 Squires ..... B32B 7/022 428/521
2013/0111839 A1 * 5/2013 Efros ..... E04G 23/0237 52/391
2013/0118105 A1 * 5/2013 Efros ..... E04F 15/16 52/391
2015/0267414 A1 * 9/2015 Mora ..... E04D 12/004 52/698
2018/0291613 A1 * 10/2018 Jackson ..... E04H 6/025
2021/0388607 A1 * 12/2021 Wright ..... E04B 1/2604
2021/0396006 A1 * 12/2021 Collins ..... B32B 5/02
2022/0275635 A1 * 9/2022 Malczyk ..... E04B 1/388

FOREIGN PATENT DOCUMENTS

CN 211622736 U * 10/2020 ..... E04B 1/161
DE 60033392 T2 * 11/2007 ..... E04B 1/26
EP 0393740 A1 * 10/1990
GB 2475539 A * 5/2011 ..... E04B 7/022
GB 2480994 A * 12/2011 ..... E04B 1/7654
GB 2512565 A * 10/2014 ..... E04B 1/26
WO WO 8801667 A1 * 3/1988 ..... E04B 1/26
WO WO-9709492 A2 * 3/1997 ..... E04B 1/26
WO WO-2010037871 A1 * 4/2010 ..... E04B 1/26
WO WO-2012083391 A1 * 6/2012 ..... E04B 1/18
WO WO-2016206995 A1 * 12/2016 ..... B32B 15/20

* cited by examiner

HALF-TIMBERED HOUSE IN TIMBER-FRAME CONSTRUCTION

CROSS-REFERENCE TO RELATED APPLICATIONS

The present application claims priority to German Application No. DE 102022200474.4, filed Jan. 18, 2022, the entire disclosure of which is incorporated by reference herein.

BACKGROUND/SUMMARY

The disclosure relates to a half-timbered house of timber-frame construction of the type defined in more detail in the preamble of claim 1.

Post and beam construction, also known as storey or structural construction, is a well-established method of constructing half-timbered buildings that dates back to the Middle Ages. The post and beam construction method is a further development of the post construction method and, together with the wall plate construction method, the block construction method, the frame construction method and the panel construction method, is one of the basic timber construction systems.

The post and beam construction is wherein building-high posts form the load-bearing system of the building, extending continuously from the sill to the roof of the building. The posts are arranged in one plane for each side wall of the building. Between, or on top of, the posts are horizontally extending beams, the so-called transoms, as well as the wall plate. Vertical corner posts are arranged at the edges of the planes. Beams running diagonally between the posts are called struts. The open space between the beams is called a compartment and is typically filled with an insulating material.

The post and beam construction method is a comparatively simple form of construction and thus enables buildings to be constructed quickly and cost-effectively. However, the disadvantage is that the individual beams touch at many points due to the design and thus form a large number of thermal bridges. This increases the U-value of the building, which in turn increases the heating requirement in winter. There is therefore a need to further develop half-timbered houses in order to reduce their heat loss. At the same time, the simple construction of the building should be maintained so that the building can be erected quickly and easily.

A building made of special blocks is known from EP 2 891 753 A1 of the applicant. The building has a post and beam construction with posts offset orthogonally to a wall plane. S-shaped blocks of an insulating material are inserted into the space between the staggered posts, which enables a particularly simple construction of the building.

DE 44 34 075 A1 discloses a wooden house. To increase the insulation value of the wooden house, the roof beams on the inside of the house are laid on a respective support beam offset from the posts. This creates a gap between the roof beams and the posts, which helps to reduce thermal bridges.

DE 94 19 795 U1 discloses a wall structure for a building in post and beam construction. The wall construction comprises insulating panels made of rigid foam material with statically supporting strips inserted into the panel surface, which are arranged between the posts of the structure. Fields are left free between the posts to accommodate conduits.

The wall construction allows for high stability and insulation effect with low building and construction costs at the same time.

A skeleton for the construction of a building is known from DE 198 34 344 A1. The skeleton is wherein all beams used for the construction of the skeleton have the same cross-section, i.e. the same cross-sectional shape and cross-sectional area. This simplifies the construction of the skeleton, since only one construction material, namely a beam with a specific cross-sectional shape and cross-sectional area, needs to be used to construct the skeleton.

Furthermore, a passive house is known from DE 198 41 922 A1. The passive house comprises a structural framework as a support for an inner and outer cladding. At the connection between the outer cladding and the inner cladding, there are open transitions in some areas, which are filled with a pneumatically applied insulating material. This provides an energy-saving and ecological passive house, which can be built with a high proportion of self-construction and at low cost.

In addition, DE 600 33 392 T2 discloses a three-shell building structure consisting of an inner, middle and outer structural framework. In this case, the rafters of the inner framework are supported directly on the posts of the inner framework and the rafters of the outer framework are supported directly on the posts of the outer framework.

Support elements for house modules are also known from EP 3 015 613 A1. Several such support elements can also be integrated into one kit.

The present disclosure is based on the object of specifying an improved half-timbered house in timber-frame construction which, compared to known construction methods, has a lower heat loss and can be constructed in a particularly simple and cost-effective manner.

According to the disclosure, this object is solved by a half-timbered house of timber-frame construction having the features of claim 1. Advantageous embodiments and further developments result from the claims dependent thereon.

A half-timbered house according to the disclosure with a multi-shell wall structure comprises a rafter roof having a plurality of rafters and side walls, which in turn each comprise at least one sill resting on a substrate and a plurality of posts (which may also be termed as studs), wherein the posts extend vertically from the sill to the rafter roof. In this case, for at least one side wall, a first number of posts are designed as inner posts and a second number of posts are designed as outer posts, wherein the inner posts are arranged offset from the outer posts in a wall orthogonal direction to a respective side wall and are positioned closer to an inner space enclosed by the side walls in the wall orthogonal direction than the outer posts, so that the respective pairings of lower rafters with inner posts form a first structural framework and the respective pairings of upper rafters with outer posts form a second structural framework. For at least one side of the roof, a first number of rafters are designed as lower rafters and a second number of rafters are designed as upper rafters, wherein the lower rafters are arranged offset from the upper rafters in a roof orthogonal direction to a respective side of the roof and are positioned closer to the interior in the roof orthogonal direction than the upper rafters, wherein a respective lower rafter is supported with a section directly on an inner post and a respective upper rafter is supported with a section directly on an outer post. According to the disclosure, the multi-shell wall structure has exactly two structural frameworks, wherein the first structural framework faces the interior and the second structural framework faces the surroundings. Furthermore, the respective pairs of lower rafters with inner posts have a lateral offset from the respective pairs of upper rafters with outer posts in a wall plane viewed in a horizontal direction, so that the posts of all the structural frameworks and the rafters of all the structural frameworks are not aligned with each other at any point viewed in the wall orthogonal direction.

The construction method of the half-timbered house according to the disclosure thus provides, on the one hand, for the roof rafters to be supported directly or indirectly on the posts. This makes it possible to dispense with the wall plate (or top plate) typically used in timber-frame construction to support the rafters on the posts. The wall plate represents a horizontally extending continuous beam that is normally placed on top of the posts, which in turn is then used to support the rafters. Since the wall plate extends continuously along a respective side wall, it forms a comparatively significant thermal bridge. If, on the other hand, the wall plate is dispensed with, this thermal bridge is eliminated, since the thermal insulation thus extends uninterruptedly from the sill to the roof gable. Dispensing with the wall plate also reduces the effort and costs required to build the half-timbered house according to the disclosure, since less building material is required and fewer work steps are needed to raise the half-timbered house.

Secondly, according to the disclosure, the lower rafters are supported on the inner posts and the upper rafters on the outer posts. The number of lower rafters and inner posts on the one hand and the number of upper rafters and outer posts on the other is thus the same. In general, the first number can also correspond to the second number. In this case, the combination of lower rafters with inner posts and upper rafters with outer posts has a significant effect on the insulation effect of the building envelope of the half-timbered house. Thus, with different interior and exterior temperatures, a temperature gradient generally exists through the walls of a building. In winter, a warm interior is separated from a cold exterior environment, while in summer the opposite is true. The upper rafters and outer posts are closer to the outside of the building in the building envelope, and therefore on a "cold side" in the winter. The lower rafters and inner posts, on the other hand, are closer to the interior, and thus have a comparatively higher temperature. The construction method of the half-timbered house according to the disclosure now provides for the "warm beams" and the "cold beams" to be supported on each other, i.e. a "warm part of the building" is insulated from a "cold part of the building". This allows heat conduction from the warm side of the building envelope to be further reduced to the cold side, quite the opposite of the conventional construction method with only one type of post and one type of rafter, in which heat conduction between the roof and the posts and along a respective side wall plane is also promoted by the wall plate.

The upper and lower rafters can rest loosely on the respective inner or outer posts or be firmly connected to them. Proven connection techniques can be used for this purpose, such as plug-in connections, screw connections, a connection with rivets, nails or the like.

An advantageous further development of the half-timbered house according to the disclosure is that an area extending horizontally in a side wall plane between two adjacent upper rafters is filled with an insulating material, wherein the insulating material extends vertically at least as far as the contact surface of the upper rafters on the outer posts. By dispensing with the wall plate, it is possible to insert continuous insulation between the upper rafters in a respective side wall plane. This improves the insulation effect even further, so that a particularly low U value can be achieved for the half-timbered house. The insulating material extends vertically at least as far as the contact surface of the upper rafters on the outer posts, but preferably even further, in particular continuously as far as the sill of a respective side wall. This ensures a particularly high insulation effect.

According to a further advantageous design of the half-timbered house, the insulating material is formed by at least one insulating block in which recesses are made for the passage of posts, rafters and/or spanning members (which may also be termed as noggins). A design of the insulating material as an insulating block enables a particularly fast and simple installation of the insulating material. The recesses, for example in the form of grooves, make it particularly intuitive for an installer to recognize in which orientation a respective insulation block is to be installed. The provision of grooves also makes it easy to slide a respective insulation block onto a corresponding post, rafter or spanning member. The insulation blocks are available in defined dimensions so that they do not have to be cut to size on site. This further reduces the working time required to install the insulation blocks. Furthermore, mistakes during installation, such as insufficient foaming of a cavity with an insulation foam, can be avoided, which also benefits the insulation effect of the half-timbered house.

A further advantageous design of the half-timbered house according to the disclosure further provides that the lower rafters have a greater surface moment of inertia about an axis lying in a cross-section of a lower rafter and extending horizontally than the upper rafters. On the one hand, this allows the flexural strength of the lower rafters to be increased compared with the upper rafters, so that the lower rafters can carry a greater load. Thus, the lower rafters serve to bear the main load of the rafter roof and the upper rafters as a support element for fastening a roof covering such as roof tiles. For this purpose, the roof covering is connected to the upper rafters via an appropriate support structure. The cost of the rafter roof can thus be reduced.

On the other hand, this allows the thermal mass of the building to be increased on the "inside", i.e. on the "warm side of the building" in winter and on the "cold side of the building" in summer, since more material and thus more mass is used to form the lower rafters. This improves user comfort when using the building. Thus, the building better retains heat in winter and cold in summer. Thus, the interior of the half-timbered house cools down more slowly in winter and heats up more slowly in summer. In the case of an opposite design, i.e. "thick" upper rafters and "thin" lower rafters, on the other hand, the positive effect would be less pronounced, or would even be absent, since the upper rafters are more exposed to the outside environment.

To increase the flexural strength of the lower rafters, it would generally also be possible to provide the lower rafters in a material with a higher modulus of elasticity than the material from which the upper rafters are made. In the case of a half-timbered house, different types of wood could be used to form the upper and lower rafters. In this case, the choice of a heavier material for forming the lower rafters further favors the advantageous distribution of the thermal mass of the half-timbered house.

According to a further advantageous design of the half-timbered house according to the disclosure, the lower rafters have a rectangular cross-section, with the long side of the cross-section being aligned vertically. This makes it possible to increase the bending stiffness of the lower rafters in a particularly simple manner.

Preferably, the pairings of lower rafters with inner posts and upper rafters with outer posts alternate when viewed in the plane of the side wall. Generally speaking, it is possible for the same pairing of lower rafters with inner posts or upper rafters with outer posts to follow one another several times in succession when viewed in the direction of the side wall plane. For example, three lower rafters each could rest on an inner post, followed by two upper rafters on two outer posts. The alternating arrangement of the said pairings, however, makes it possible to achieve a particularly uniform static load on the building structure. A corner post can be provided at a respective end of a side wall, which can be arranged in line with the inner posts, outer posts or also offset from them, for example centrally between the outer posts and inner posts. In particular, the corner post can have a larger cross-section than the respective outer and inner posts.

BRIEF DESCRIPTION OF THE DRAWINGS

Further advantageous designs of the half-timbered house according to the disclosure also result from the exemplary embodiments, which are described in more detail below with reference to the figures, wherein.

DETAILED DESCRIPTION

Figure 1:
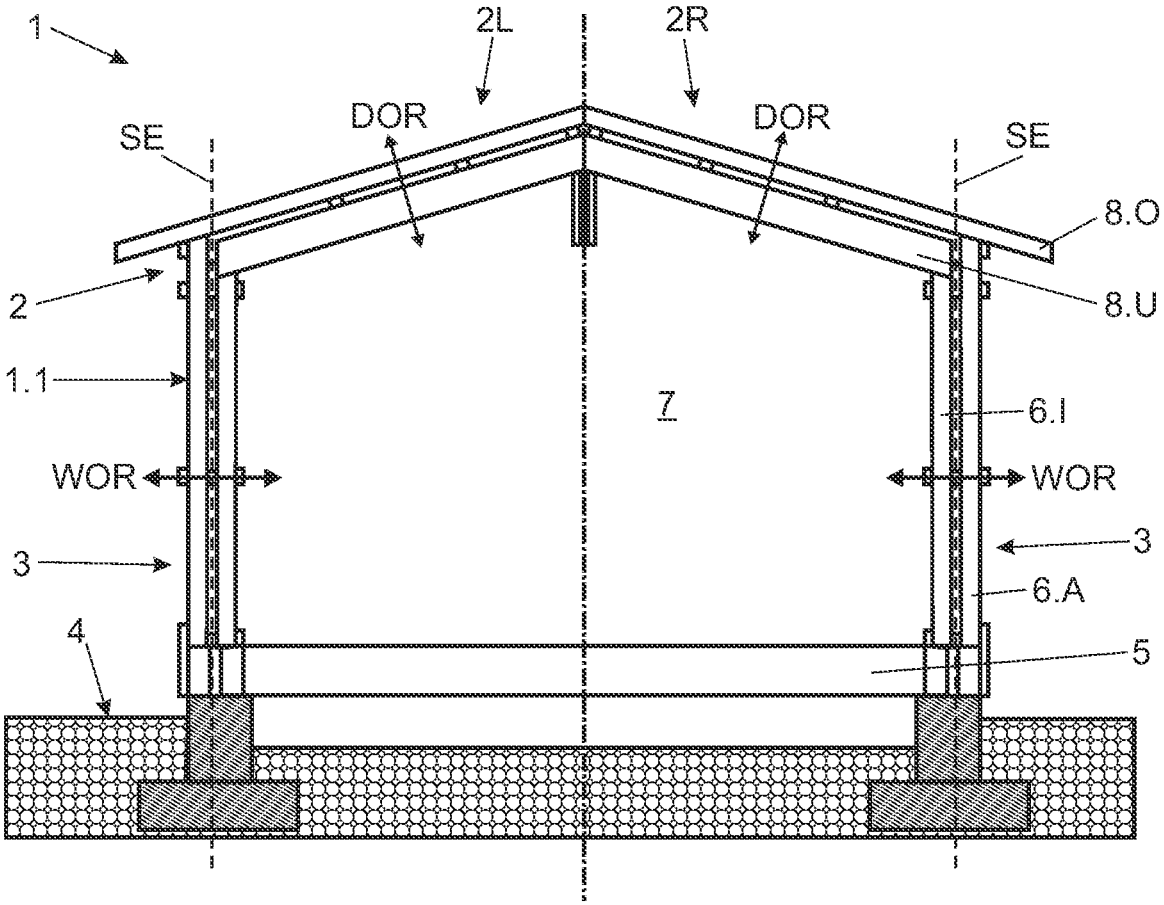
FIG. 1 shows a frontal view of the framework of a half-timbered house according to the disclosure.

FIG. 1 shows a frontal view of a framework 1.1 of a half-timbered house 1 according to the disclosure. The half-timbered house 1 comprises a rafter roof 2 having a left and a right roof side 2R, 2L. The rafter roof 2 in turn comprises lower rafters 8.U and upper rafters 8.O arranged offset to each other in a roof orthogonal direction DOR extending orthogonally to a respective roof side 2R, 2L. In this case, the lower rafters 8.U face an interior 7 of the half-timbered house 1 and the upper rafters 8.O face the exterior of the half-timbered house 1.

Further, the half-timbered house 1 comprises four side walls 3, a respective side wall 3 having a plurality of posts extending from a sill 5 resting on a substrate 4 to the rafter roof 2. The sill 5 may also be supported on the substrate 4 by a foundation. In this case, the posts of at least one side wall 3, in the shown exemplary embodiments of two opposing side walls 3 of the half-timbered house 1, are arranged offset from one another in a wall orthogonal direction WOR extending orthogonally to a side wall plane SE. The side walls 3 enclose the interior 7, with the outer posts 6.A facing the outside of the half-timbered house 1 and inner posts 6.I facing the interior 7.

In this case, a respective lower rafter 8.U is supported with a section directly on an inner post 6.I and a respective upper rafter 8.O is supported with a section directly on an outer post 6.A. Accordingly, the number of lower rafters 8.U is equal to the number of inner posts 6.I and the number of upper rafters 8.O is equal to the number of outer posts 6.A. The respective rafters may simply rest on the respective posts or may also be firmly connected thereto. "Directly" in this context means that there is no other (wooden) beam between a respective rafter and post. However, there may, for example, be fasteners such as connecting plates, nails, washers, angles or the like between them.

Figure 2:
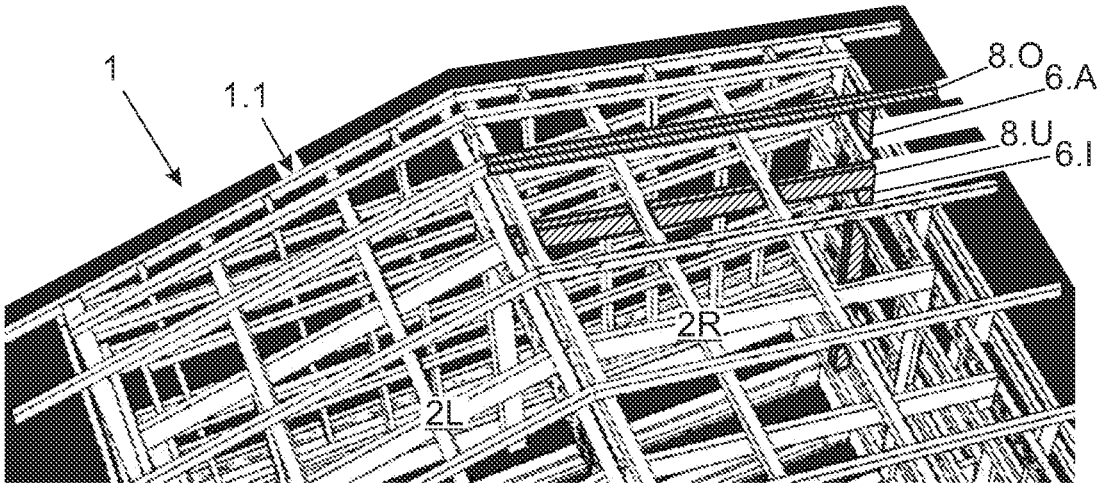
FIG. 2 shows a perspective view of the framework of the half-timbered house according to the disclosure.

FIG. 2 shows the pairing of lower rafter 8.U with inner posts 6.I and upper rafter 8.O with outer posts 6.A in perspective. One pairing is highlighted by hatching in each case.

The lateral offset of the said pairings from each other in a horizontal direction lying in the wall plane SE can be clearly seen.

This construction method has several advantages. The fact that the rafters rest directly on the posts makes it possible to dispense with the usual wall plate in such a framework construction. The wall plate usually rests on the posts and extends horizontally on them in the side wall plane SE. The rafters then rest on the wall plates. By eliminating the wall plate, the cost of the half-timbered house 1 can be reduced because less construction material is required and fewer steps are needed to raise the building. Furthermore, this eliminates thermal bridges.

The upper rafters 8.O and the outer posts 6.A are located closer to the outside of the half-timbered house 1 as viewed through the building envelope, which means that they have a comparatively low temperature in winter. The lower rafters 8.U and the inner posts 6.I are located closer to the interior 7, and thus have a comparatively higher temperature in winter. The pairing of the lower rafters 8.U on the inner posts 6.I prevents heat from flowing out of the comparatively warmer building structure into comparatively colder structural parts, i.e. the upper rafters 8.O or the outer posts 6.A. The lower rafters 8.U and the inner posts 6.I are arranged closer to the interior 7, and thus have a comparatively higher temperature in winter.

In addition, the lower rafters 8.U are designed stronger than the upper rafters 8.O, which means that more thermal mass is shifted to the "inner side of the building", i.e. the side of the building that is warmer in winter.

Figure 3:
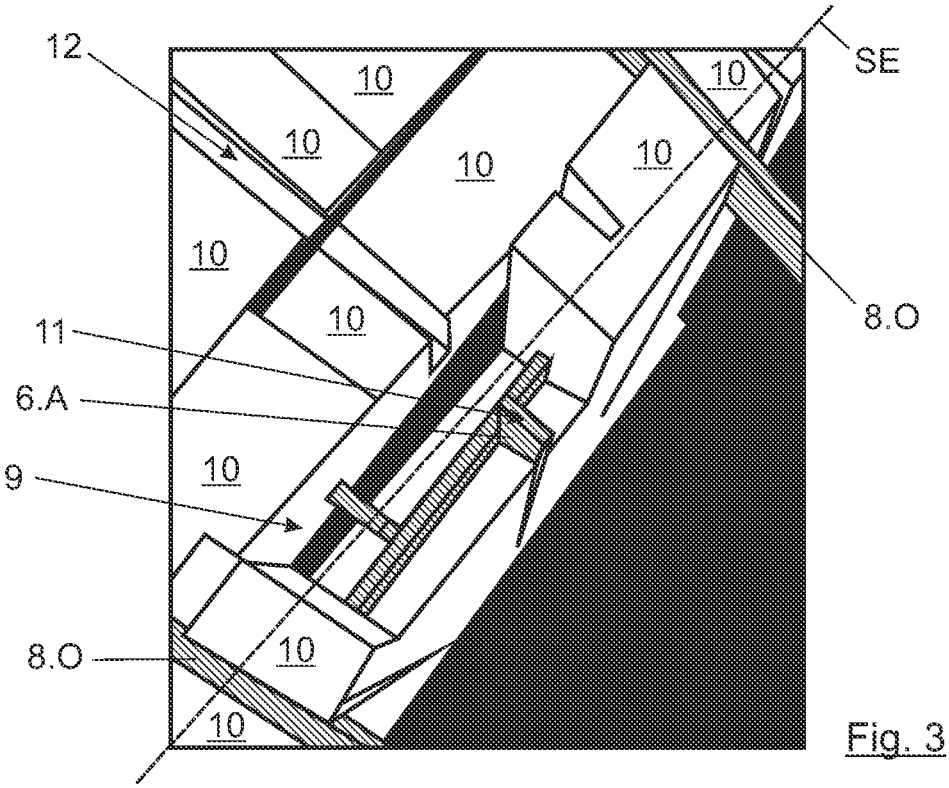
FIG. 3 shows a detailed perspective view of an area between two adjacent upper rafters prior to installation of an insulation block.
Figure 4:
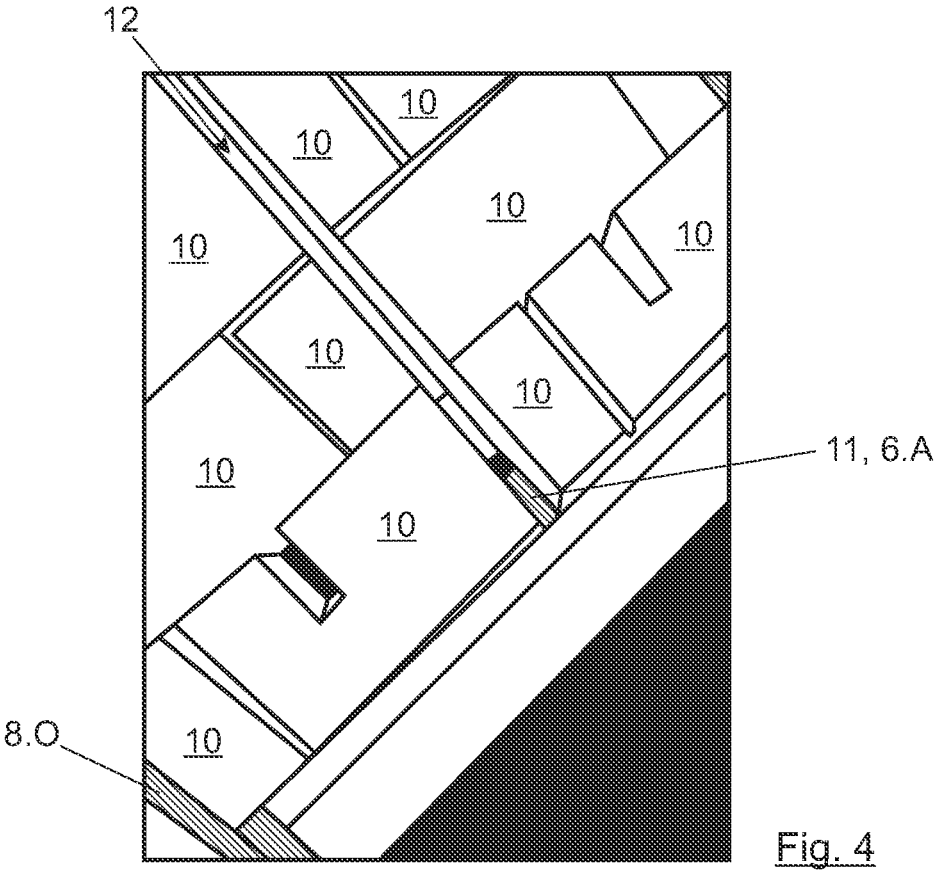
FIG. 4 shows the detailed perspective view from FIG. 3 after installation of the insulation block and before installation of a further upper rafter.
Figure 5:
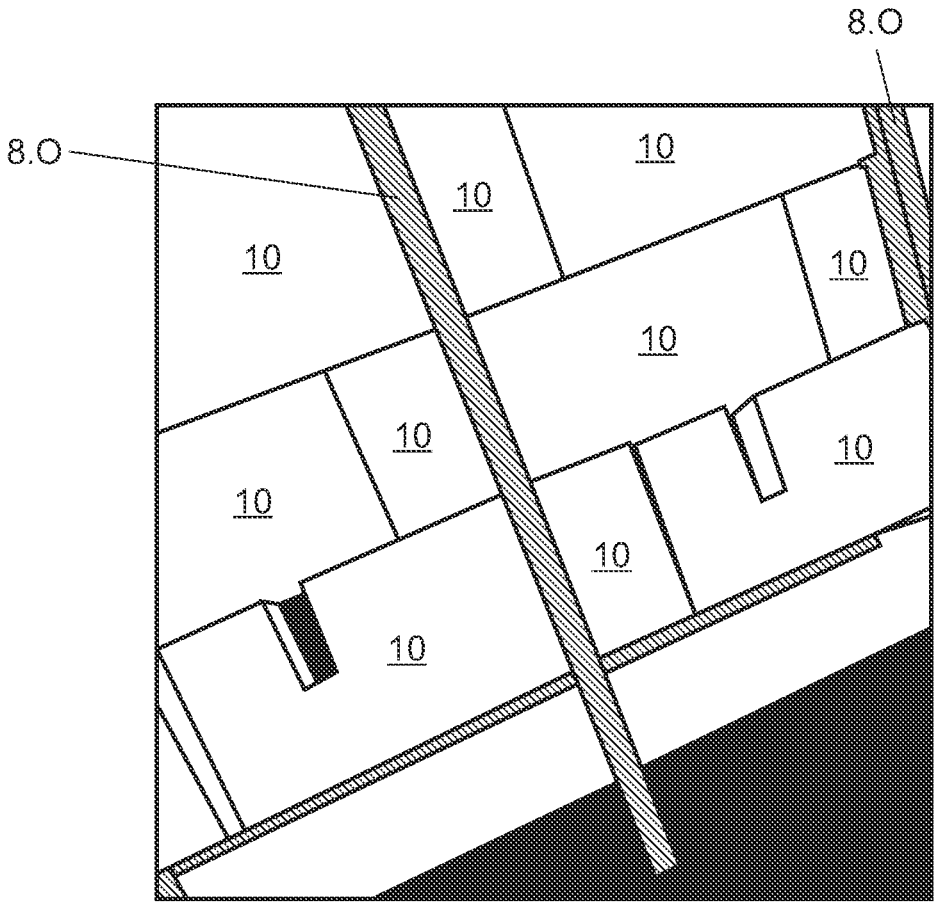
FIG. 5 shows the detailed perspective view from FIG. 4 after installation of the upper rafter.

FIGS. 3 to 5 show the installation of an insulation material 10 in an area 9 between adjacent upper rafters 8.O. The construction method of the half-timbered house 1 according to the disclosure enables continuous insulation in the area 9 extending in the side wall plane SE between adjacent upper rafters 8.O. In this case, a corresponding insulating material 10 extends vertically at least as far as a contact surface 11 of the upper rafters 8.O on the outer posts 6.A. This ensures particularly efficient thermal insulation. Most preferably, the respective insulating material 10 extends down to the sill 5. According to one embodiment, the insulating material 10 is formed by a plurality of insulating blocks, which makes it particularly easy and safe to install the insulating material 10.

The simple construction method of the half-timbered house 1 according to the disclosure is further supported in that recesses 12 in the form of grooves are made in the insulating material 10 or the insulating blocks, respectively, into which posts, rafters and/or spanning members of the half-timbered house 1.1 are inserted. In this way, the corresponding insulation blocks can simply be fitted onto each other or onto the framework 1.1.

In FIG. 4, the view from FIG. 3 is shown again, wherein a gaping hole in the insulation has now been filled by a missing insulation block. FIG. 4 shows a recess 12 extending through the insulation material 10, through which the contact surface 11 of an outer stand 6.A extends.

FIG. 5 now shows an upper rafter 8.O set into the corresponding recess 12, which is then supported on the corresponding contact surface 11.

Figure 6:
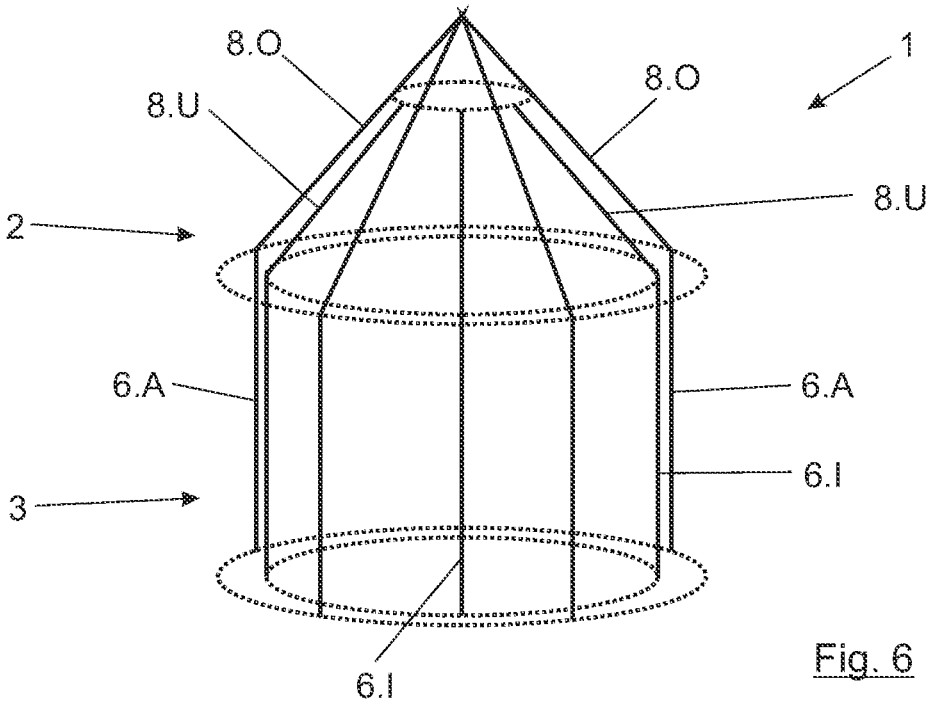
FIG. 6 shows a schematic perspective view of a half-timbered house according to the disclosure with a circular ground plan.

In general, it is possible that the half-timbered house 1 according to the disclosure does not have a square or rectangular ground plan, but any ground plan, for example an oval ground plan, or as indicated in the schematized FIG. 6, a circular ground plan. Accordingly, a side wall 3 also runs circularly. Also in the case of such a side wall 3, the posts can be designed offset from one another in the radial direction to the shell surface in the direction of the interior 7 or in the direction of the exterior of the half-timbered house 1 in the wall orthogonal direction WOR, with corresponding pairings of matching upper and lower rafters 8.O, 8.U of the rafter roof 2. The respective pairings then have a horizontal offset along the circumference of the half-timbered house 1.

LIST OF REFERENCE SIGNS

1 Half-timbered house
1.1 Framework
2 Rafter roof
2L Roof side
2R Roof side
3 Side wall
4 Substrate
5 Sill
6.A Outer post
6.I Inner post
7 Interior
8.U Lower rafter
8.O Upper rafter
9 Area
10 Insulation material
11 Contact surface
12 Recess
DOR Roof orthogonal direction
SE Side wall plane
WOR Wall orthogonal direction

The invention claimed is:

1. Half-timbered house of timber-frame construction having a multi-shell wall structure, comprising: a rafter roof having a plurality of rafters; and walls, which each comprise: at least one sill resting on a substrate; and a plurality of posts extending vertically from the sill to the rafter roof; wherein for at least one wall part, a first number of posts are designed as inner posts and a second number of posts are designed as outer posts, wherein the inner posts are arranged offset from the outer posts in a wall orthogonal direction relative to a respective wall and are positioned in this case closer in the wall orthogonal direction to an interior enclosed by the walls than the outer posts; for at least one roof side, a first number of rafters are designed as lower rafters and a second number of rafters are designed as upper rafters, wherein the lower rafters are arranged offset from the upper rafters in a roof orthogonal direction to a respective roof side and are positioned in this case closer to the interior in the roof orthogonal direction than the upper rafters; a respective lower rafter is supported with a section directly on an inner post and a respective upper rafter is supported with a section directly on an outer post, so that the respective pairings of lower rafters with inner posts form a first structural framework and the respective pairings of upper rafters with outer posts form a second structural framework, wherein the multi-shell wall structure comprises exactly two structural frameworks, wherein the first structural framework faces the interior and the second structural framework faces the surroundings; and the respective pairings of lower rafters with inner posts with the respective pairings of upper rafters with outer posts in a wall plane, as viewed in a horizontal direction, have a lateral offset relative to one another, so that at no point, as viewed in the wall orthogonal direction, the posts of all structural frameworks and the rafters of all structural frameworks are aligned relative to one another.

2. Half-timbered house according to claim 1, wherein an area extending horizontally in a wall plane between two adjacent upper rafters is filled with an insulating material, wherein the insulating material extends vertically at least as far as the contact surface of the upper rafters on the outer posts.

3. Half-timbered house according to claim 2, wherein the insulating material is formed by at least one insulating block in which recesses are made for the passage of posts, rafters and/or spanning members.

4. Half-timbered house according to one of claims 3, wherein the lower rafters have a larger area moment of inertia about an axis lying in a cross-section of a lower rafter and extending horizontally than the upper rafters.

5. Half-timbered house according to claim 3, wherein as viewed into the wall plane, the pairings of lower rafter with inner post and upper rafter with outer post alternate.

6. Half-timbered house according to claim 1, characterized in that whereinas viewed into the wall plane, the pairings of lower rafter with inner post and upper rafter with outer post alternate.

7. Half-timbered house according to claim 2, wherein the lower rafters have a larger area moment of inertia about an axis lying in a cross-section of a lower rafter and extending horizontally than the upper rafters.

8. Half-timbered house according to claim 2, wherein as viewed into the wall plane, the pairings of lower rafter with inner post and upper rafter with outer post alternate.

9. Half-timbered house according to claim 2, wherein the house has a ground plan deviating from the rectangular shape, in particular a circular or oval ground plan.

10. Half-timbered house according to claim 1, wherein the lower rafters have a larger area moment of inertia about an axis lying in a cross-section of a lower rafter and extending horizontally than the upper rafters.

11. Half-timbered house according to claim 10, wherein the lower rafters have a rectangular cross-section, wherein the long side of the cross-section is oriented vertically.

12. Half-timbered house according to claim 11, wherein as viewed into the wall plane, the pairings of lower rafter with inner post and upper rafter with outer post alternate.

13. Half-timbered house according to claim 11, wherein the house has a ground plan deviating from the rectangular shape, in particular a circular or oval ground plan.

14. Half-timbered house according to claim 10, wherein as viewed into the wall plane, the pairings of lower rafter with inner post and upper rafter with outer post alternate.

15. Half-timbered house according to claim 10, wherein the house has a ground plan deviating from the rectangular shape, in particular a circular or oval ground plan.

16. Half-timbered house according to claim 3, wherein the house has a ground plan deviating from the rectangular shape, in particular a circular or oval ground plan.

17. Half-timbered house according to claim 6, wherein the house has a ground plan deviating from the rectangular shape, in particular a circular or oval ground plan.

18. Half-timbered house according to claim 1, wherein the house has a ground plan deviating from the rectangular shape, in particular a circular or oval ground plan.

* * * * *